US006103982A

United States Patent [19]

Chien

[11] Patent Number: 6,103,982

[45] Date of Patent: Aug. 15, 2000

[54] CONTACT INDICATING SWITCH

[75] Inventor: Chih-Che Chien, Taipei Hsien, Taiwan

[73] Assignee: Shin Jiuh Corp., Taipei Hsien, Taiwan

[21] Appl. No.: 09/249,064

[22] Filed: Feb. 12, 1999

[51] Int. Cl.[7] ..... H01H 9/18

[52] U.S. Cl. ..... 200/315; 200/276

[58] Field of Search ..... 200/315, 339, 200/276, 302.3, 306

[56] References Cited

U.S. PATENT DOCUMENTS

| | | | |
|---|---|---|---|
| 3,725,625 | 4/1973 | Pratt | 200/276 X |
| 4,431,880 | 2/1984 | Ives | 200/315 |
| 4,454,400 | 6/1984 | Sorenson | 200/315 |
| 5,451,733 | 9/1995 | Olson et al. | 200/315 |

*Primary Examiner*—Renee Luebke
*Attorney, Agent, or Firm*—Nixon & Vanderhye

[57] ABSTRACT

A contact indicating switch includes an actuator body with an upper body portion pivoted to an insulating seat body and a smaller lower body portion. The lower body portion has a downwardly opening bore that terminates at an abutment seat, and a slit communicated with the abutment seat. A biasing spring is received in the bore, and has an upper end with a finger portion extending outwardly of the slit, and a lower end biasing a rolling member to slidably engage an electrically conductive lever between a right position, where a contact end of the lever engages a right electric contact member in the seat body, and a left position, where the contact end disengages the right electric contact member. An electrically activated indicator is received in the upper body portion, and has a first terminal extending downwardly and outwardly of the upper body portion to contact a left electric contact member, and a second terminal extending in the receiving chamber. A current limiting element is received in the receiving chamber, and has an upper end abutting against the second terminal and a lower end urged by the finger portion of the biasing spring.

9 Claims, 6 Drawing Sheets

CONTACT INDICATING SWITCH

BACKGROUND OF THE INVENTION

1. Field of the Invention

This invention relates to a contact indicating switch, more particularly to a contact indicating switch which can be assembled easily without the need for conducting a soldering operation.

2. Description of the Related Art

Referring to FIGS. 1 and 2, a conventional contact indicating switch is shown to include an insulating seat body 1 and an actuator body 2 which is inserted into an upper opening 14 of the seat body 1. Three electric contact members 10,11,12 are fixed on a bottom wall of the seat body 1, and have prong portions that extend downwardly and outwardly of the bottom wall. An electrically conductive lever 13 is mounted pivotally on and is in electrical contact with the electric contact member 11 at a fulcrum thereof, and has a contact end and a non-contact end opposite to each other relative to the fulcrum. A spring plate 120 is soldered on the electric contact member 12. The actuator seat 2 has a lower cavity 23 for receiving a spring-biased conductive sleeve 25 so as to be biased to slidably engage the electrically conductive lever 13 between a right position adjacent to the contact end, where the contact end engages the electric contact member 10 (see FIG. 2), and a left portion adjacent to the non-contact end, where the contact end is disengaged from the electric contact member 10. The actuator seat 2 further has an upper cavity for receiving a neon lamp 22. The neon lamp 22 has a first conductive wire terminal 221 which extends downwardly and outwardly of the upper cavity to contact the spring plate 120 when the sleeve 25 is in the right position, and a second conductive wire terminal 220 which is soldered with one end of a resistor 26. The other end of the resistor 26 extends to contact the spring 24 of the sleeve 25. A button cap 21 is pivoted on the seat body 1 to slide the sleeve 25 in response to depression of the button cap 21.

It is noted that the spring plate 120 and the resistor 26 are mounted in a soldering manner in the limited spaces of the seat body 1 and the actuator body 2, thereby resulting in inconvenience during assembly.

SUMMARY OF THE INVENTION

The object of the present invention is to provide a contact indicating switch which can be conveniently assembled with the need for conducting a soldering operation.

According to this invention, the contact indicating switch includes an insulating seat body with a bottom wall and a circumferential wall extending from a periphery of the bottom wall. Right, left and middle electric contact members have terminal portions disposed in tandem on the bottom wall, and prong portions extending downwardly and outwardly of the bottom wall. An electrically conductive lever is pivoted on the middle terminal portion at a fulcrum thereof, and has contact and non-contact ends opposite to each other relative to the fulcrum. An actuator body is inserted into an upper opening of the seat body, and includes an upper body portion and a lower body portion which extends downward from the upper body portion and which has a dimension smaller than that of the upper body portion so as to form a shoulder wall therebetween. The upper body portion has an upwardly opening upper cavity and a downwardly opening receiving chamber to communicated with the shoulder wall. The lower body portion has a bore that opens downward and that extends upward to terminate at an abutment seat, and further has a slit that extends upward proximate to the shoulder wall so as to communicate with the abutment seat. A biasing spring is received in the bore, and has a proximate end relative to the abutment seat to extend radially and outwardly of the slit to form a finger portion below the shoulder wall. A rolling member is retained rotatably in the bore and is biased downwardly by a distal end of the biasing spring. Thus, the actuator body is pivoted on the circumferential wall of the seat body to bring the rolling member to slidably engage the electrically conductive lever against the biasing action of the biasing spring between a right position adjacent to the contact end, where the contact end engages the right terminal portion, and a left position adjacent to the non-contact end, where the contact end disengages from the right terminal portion. An electrically activated indicator is disposed in the upper cavity, and includes a first electrically conductive wire terminal extending downwardly and outwardly of the upper cavity so as to engage or disengage the left terminal portion when the rolling member is in the right or left position, and a second electrically conductive wire terminal extending into the receiving chamber to be spaced from the finger portion. A current limiting element is received in the receiving chamber, and has an upper end abutting against the second electrically conductive wire terminal and a lower end urged by the finger portion. As such, the current limiting element can be inserted into the receiving chamber to contact the second electrically conductive wire terminal and the biasing spring, thereby resulting in convenience when assembling the same. In addition, the left electric contact member further has a resilient conductive member sleeved on the left terminal portion, instead of the spring plate of the prior art described above, so as to provide a resilient contact pad for engaging the first electrically conductive wire.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
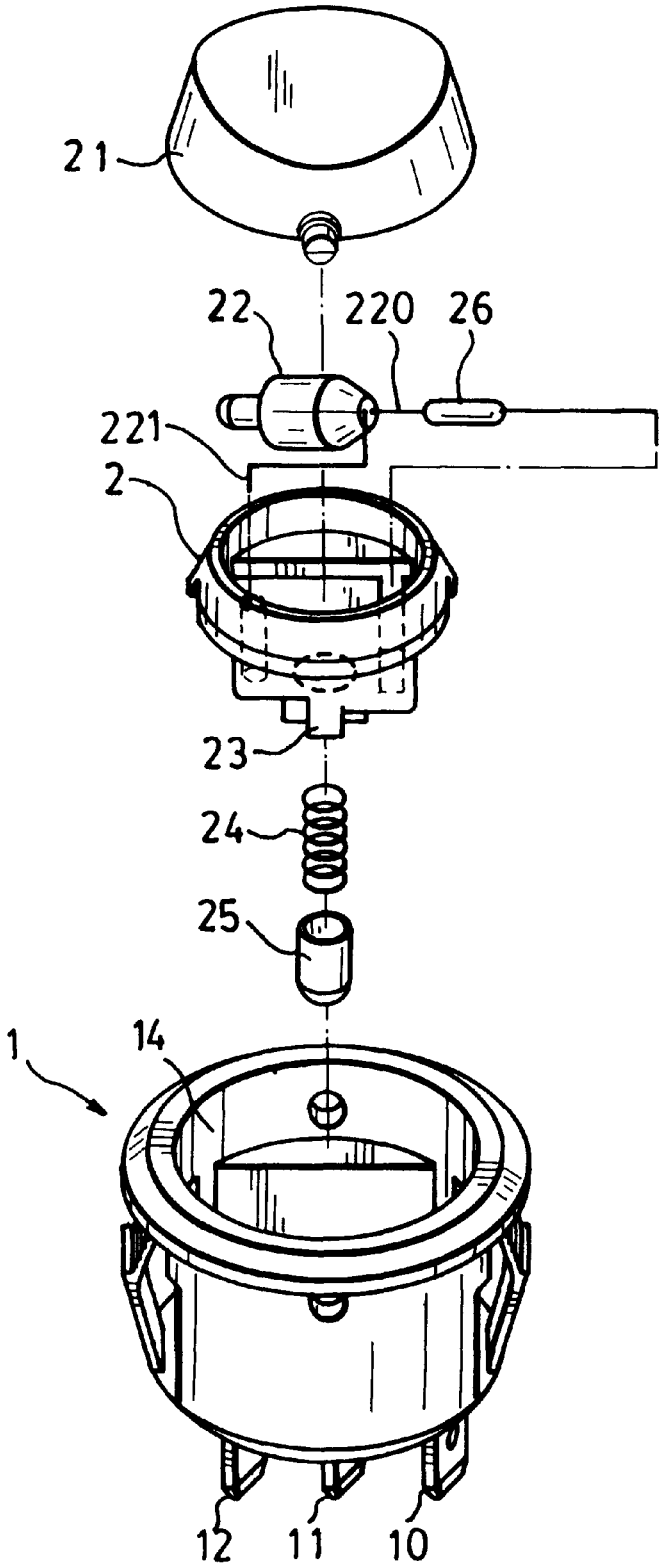
FIG.1 PRIOR ART
FIG. 1 is an exploded view of a conventional contact indicating switch.
Figure 2:
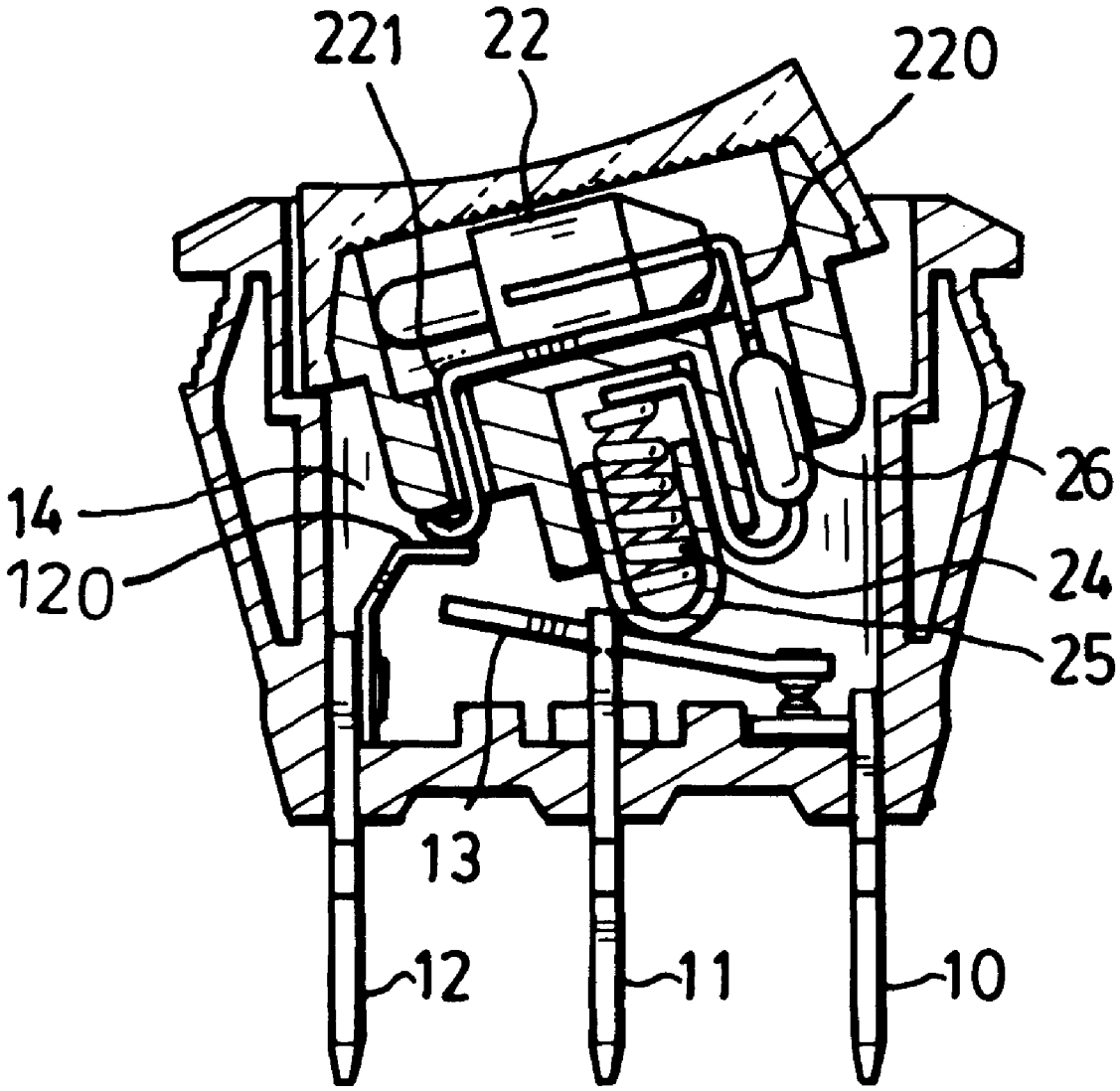
FIG. 2 PRIOR ART
FIG. 2 is a sectional view of the conventional contact indicating switch.
Figure 3:
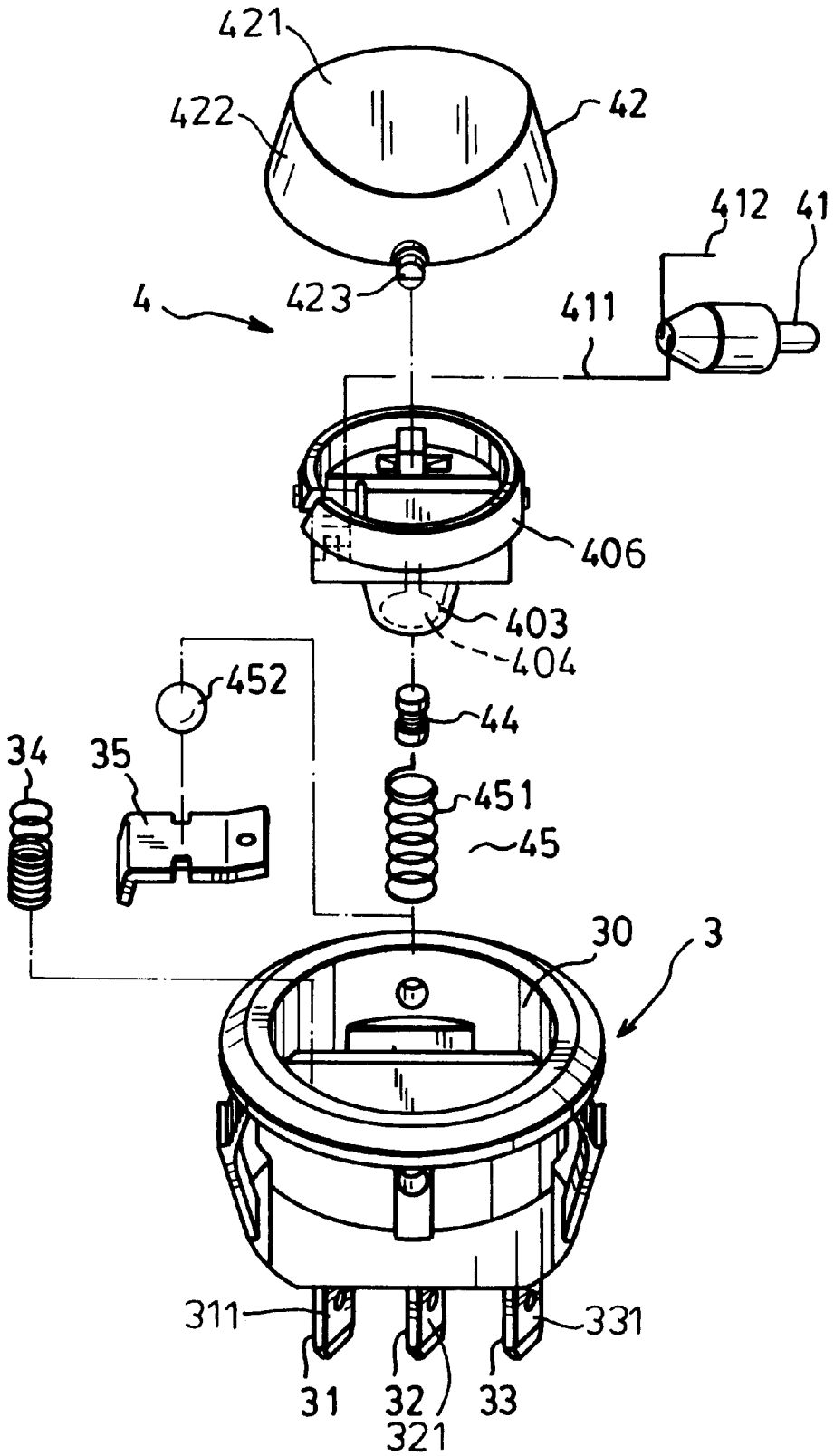
FIG. 3 is an exploded view of a preferred embodiment of a contact indicating switch according to this invention.
Figure 6:
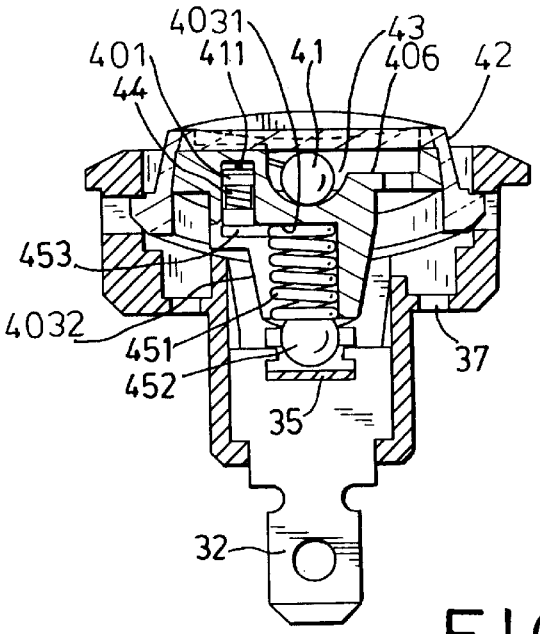
FIG. 6 is a sectional view of the contact indicating switch shown in FIG. 5, taken along lines 6—6 thereof.
Figure 7:
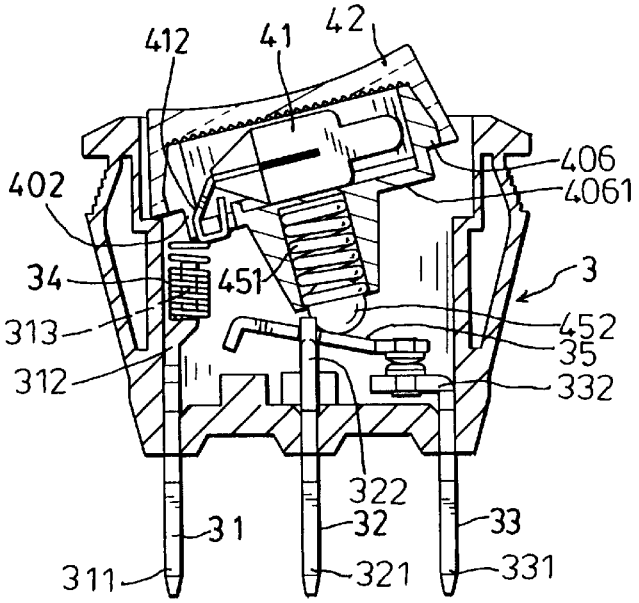
FIG. 7 is a sectional view of the contact indicating switch shown in FIG. 5, taken along lines 7—7 thereof in a switch-on state.

Referring to FIGS. 3, 6 and 7, the preferred embodiment of the contact indicating switch according to the present invention is shown to comprise an insulating seat body 3 and an actuator body 4.

Figure 4:
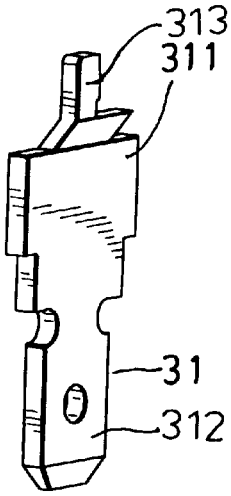
FIG. 4 is a perspective view of a left electric contact member of the preferred embodiment.

The seat body 3 includes a bottom wall with a periphery, and a circumferential wall which extends from the periphery upwardly around a first axis to terminate with an upper annular end which has an inner annular upper portion to define an upper opening 30. Right, left and middle electric contact members 33,31,32 respectively include right, left and middle terminal portions 332,312,322 which are spacedly disposed in tandem on the bottom wall of the seat body 3 in a first transverse direction relative to the first axis, and right, left and middle prong portions 331,311,321 which are integrally formed with and which extend respectively from the right, left and middle terminal portions 332,312, 322 downwardly and outwardly of the bottom wall in a first longitudinal direction parallel to the first axis. Referring to FIGS. 4 and 7, the left electric contact member 31 has a converging portion 313 which projects upwardly from the left prong portion 311. A resilient conductive member 34, such as a coil spring, is sleeved on the converging portion 313.

An electrically conductive lever 35 is pivotally mounted on and is in electrical contact with the middle terminal portion 322 at a fulcrum 351 thereof. The electrically conductive lever 35 includes a contact end 352, a non-contact end 353 opposite to the contact end 352 relative to the fulcrum 351, and a sliding path which is disposed between the contact and non-contact ends 352,353 and opposite to the fulcrum 351 in the first longitudinal direction.

The actuator body 4 is insertable into the upper opening 30, and includes an upper body portion 406 with a first dimension, and a lower body portion 304 which extends downward and in a second longitudinal direction from the upper body portion 406 and which is of a second dimension smaller than the first dimension so as to form a shoulder wall 4061 that faces downward and that extends in a second transverse direction relative to the second longitudinal direction. With reference to FIG. 6, the upper body portion 406 defines an upper cavity 43 which opens upward, and a receiving chamber 401 which defines a second axis and which opens downward to communicate with the shoulder wall 4061. The lower body portion 403 defines a bore 404 which opens downward and which extends upwards in a third axis parallel to the second axis to terminate at an abutment seat 4031. The lower body portion 403 further has a slit 4032 which extends upward and in a direction parallel to the third axis to a position proximate to the shoulder wall 4061 so as to communicate with the abutment seat 4031 in a direction radial to the third axis. In addition, a button cap 42 has a top wall 421 with right and left side portions opposite to each other relative to the third axis, and a surrounding wall 422 which extends downwardly from a periphery of the top wall 421 to terminate with a lower annular portion. The surrounding wall 422 is disposed to fit with the upper body portion 406, and includes two mounting pins 423 which are spaced apart from each other along a fourth axis transverse to both of the first transverse direction and the first longitudinal direction for pivotally mounting the actuator body 4 on the circumferential wall of the seat body 3.

A spring-biased member 45 includes a biasing spring 451 and a rolling member 452. The biasing spring 451 is received in the bore 404, and has a distal end relative to the abutment seat 4031, and a proximate end which extends radially and outwardly of the slit 4032 to form a finger portion 453 that is below the shoulder wall 4061, that is in transverse to the second axis, and that is movable along the slit 4032. The rolling member 452 is retained rotatably in the bore 404 and is biased downwardly along the third axis by the distal end of the biasing spring 451.

Figure 5:
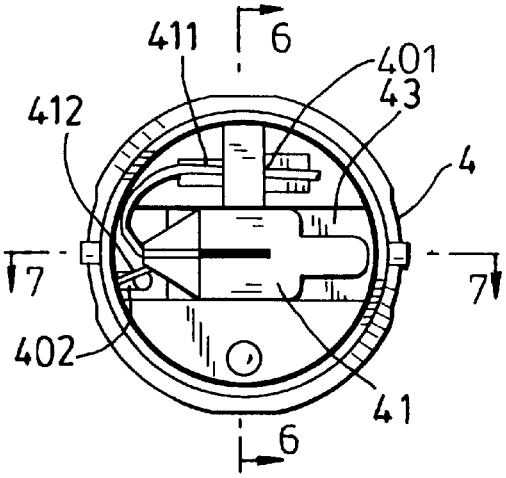
FIG. 5 is a top view of a portion of the preferred embodiment.
Figure 8:
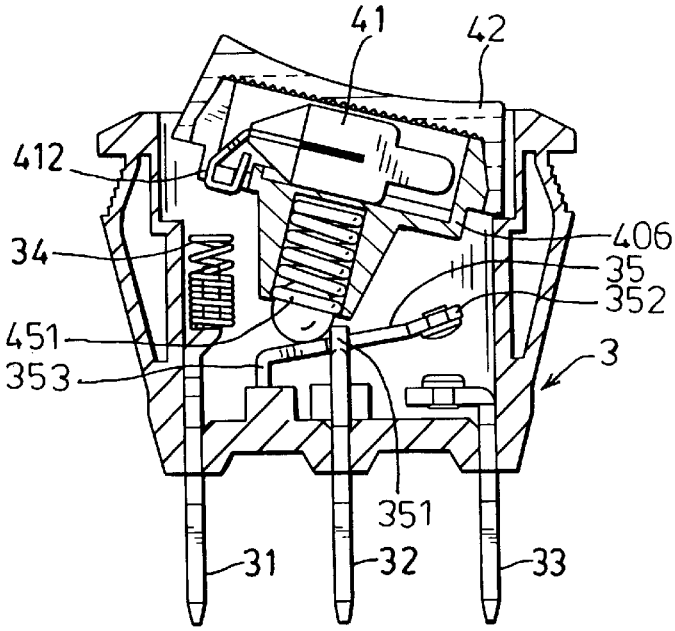
FIG. 8 is a sectional view similar to FIG. 7 but in a switch-off state.

As illustrated, the actuator body 4 is pivotally mounted on the circumferential wall of the seat body 3 adjacent to the inner annular upper portion about the fourth axis so as to bring the rolling member 452 to slidably engage the electrically conductive lever 35 against a biasing action of the biasing spring 34 and along the sliding path. In particular, as shown in FIG. 7, when the left side portion of the button cap 42 is depressed, the rolling member 452 slidably engages a right position adjacent to the contact end 352, where the contact end 352 engages the right terminal portion 332. On the other hand, as shown in FIG. 8, when the right side portion of the button cap 42 is depressed, the rolling member 452 slidably engages a left position adjacent to the non-contact end 353, and a left position which is adjacent to the non-contact end 353, where the contact end 352 is disengaged from the right terminal portion 332, thereby breaking the electric contact between the middle and right electric contact members 32,33. With reference to FIG. 5, an electrically activated indicator, such as a neon lamp 41 in this embodiment, is disposed in the upper cavity 43. The lamp 41 has a first electrically conductive wire terminal 412 which extends downwardly and outwardly of the upper cavity 43 via a through hole 402 and opposite to the resilient conductive member 34. Thus, when the contact end 352 of the lever 35 is disengaged from the right terminal portion 332, the first electrically conductive wire terminal 412 is disengaged from the resilient conductive member 34 (see FIG. 8). When the contact end 352 engages the right terminal portion 332, the first electrically conductive wire terminal 412 engages the left terminal portion 312 via the resilient conductive member 34 (see FIG. 7). As shown in FIG. 6, the lamp 41 further has a second electrically conductive wire terminal 411 which is disposed to extend spacedly from the finger portion 453 of the biasing spring 451 in the second axis.

A current limiting element, such as a resistor 44 in this embodiment, is received in the receiving chamber 401, and has an upper end which abuts against the second electrically conductive terminal 411, and a lower end which is urged by the finger portion 453 as the rolling member 452 slides on the lever 35 against the biasing action of the biasing spring 451.

As such, referring to FIG. 7, when the contact indicating switch of this invention is in a switch-on state, the rolling member 452 engages the right position so as to establish electrical contact between the middle electric contact member 32 and the right electric contact member 33, and the first electrically conductive wire terminal 412 engages the left terminal portion 312 so as to light the neon lamp 41. Referring to FIG. 8, when the contact indicating switch of this invention is in a switch-off state, the rolling member 452 engages the left position so as to break electrical contact between the middle electric contact member 32 and the right electric contact member 33, and the first electrically conductive wire terminal 412 disengages from the left terminal portion 312 so as to deactivate the neon lamp 41.

Since the resilient conductive member 34 is mounted on the left electric contact member 31 in a sleeving manner, and since the resistor 44 is mounted into the receiving chamber 401 in an inserting manner, the assembly operation of the contact indicating switch of this invention is convenient and easy to conduct.

Figure 9:
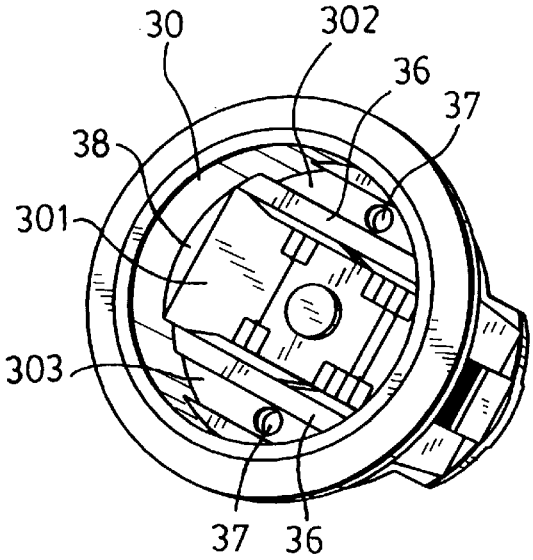
FIG. 9 is a top view of another preferred embodiment of the contact indicating switch according to this invention.

Moreover, referring to FIG. 9, the insulating seat body 4 further includes two partition walls 36 which extend upwardly from the bottom wall in the first longitudinal direction to engage the circumferential wall, and which are spaced apart from each other in a direction parallel to the fourth axis. The partition walls 36 divide the seat body 4 into a middle receiving space 301 for receiving the right, left and middle terminal portions 332,312,322, and two side chambers 302,303 which are respectively disposed below two clearances that are formed between the circumferential wall and the surrounding wall 422 of the button cap 42 and which are respectively adjacent to the mounting pins 423 so as to accumulate therein water permeating through the clearances, thereby preventing the middle receiving space 301 from being intruded by the permeating water. Two drainage outlets 37 are formed through the side chambers 302,303, respectively. In addition, the insulating seat body 3 further has two protrusions 38 which are disposed in the middle receiving space 301. Each protrusion 38 projects from the circumferential wall in the fourth axis so as to restrict further movement of the lower annular portion of the button cap 42 when one of the right and left side portions thereof is depressed.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A contact indicating switch comprising:

an insulating seat body including a bottom wall with a periphery, and a circumferential wall extending from said periphery upwardly around a first axis to terminate with an upper annular end which has an inner annular upper portion to define an upper opening;

right, left and middle electric contact members which respectively include right, left and middle terminal portions spacedly disposed in tandem on said bottom wall in a first transverse direction relative to said first axis, and right, left and middle prong portions integrally formed with, and extending respectively from said right, left and middle terminal portions downwardly and outwardly of said bottom wall in a first longitudinal direction parallel to said first axis;

an electrically conductive lever pivotally mounted on, and in electrical contact with said middle terminal portion at a fulcrum thereof, said electrically conductive lever including a contact end, a non-contact end opposite to said contact end relative to said fulcrum, and a sliding path disposed between said contact and non-contact ends and opposite to said fulcrum in said first longitudinal direction;

an actuator body of a dimension so as to be insertable into said upper opening, and including an upper body portion with a first dimension, and a lower body portion extending downward and in a second longitudinal direction from said upper body portion, said lower body portion being of a second dimension smaller than said first dimension so as to form a shoulder wall facing downward and extending in a second transverse direction relative to said second longitudinal direction, said upper body portion defining an upper cavity which opens upward, and a receiving chamber which defines a second axis and which opens downward to communicate with said shoulder wall, said lower body portion defining a bore which opens downward and which extends upward in a third axis that is parallel to said second axis to terminate at an abutment seat, said lower body portion having a slit that extends upward and in a direction parallel to said third axis to a position proximate to said shoulder wall so as to communicate with said abutment seat in a direction radial to said third axis;

a biasing spring received in said bore, and having a distal end relative to said abutment seat, and a proximate end extending radially and outwardly of said slit to form a finger portion that is below said shoulder wall, that is transverse to said second axis, and that is movable along said slit;

a rolling member retained rotatably in said bore and biased downwardly along said third axis by said distal end of said biasing spring, wherein said actuator body is disposed to be mounted pivotally on said circumferential wall adjacent to said inner annular upper portion about a fourth axis which is transverse to both of said first transverse direction and said first longitudinal direction, thereby bringing said rolling member to slidably engage said electrically conductive lever against a biasing action of said biasing spring and along said sliding path between a right position which is adjacent to said contact end, where said contact end engages said right terminal portion, and a left position which is adjacent to said non-contact end, where said contact end is disengaged from said right terminal portion;

an electrically activated indicator disposed in said upper cavity, and including a first electrically conductive wire terminal extending downwardly and outwardly of said upper cavity and opposite to said left terminal portion such that when said contact end is disengaged from said right terminal portion, said first electrically conductive wire terminal is disengaged from said left terminal portion, and when said contact end engages said right terminal portion, said first electrically conductive wire terminal engages said left terminal portion, and a second electrically conductive wire terminal disposed to extend spacedly from said finger portion along said second axis; and a current limiting element received in said receiving chamber and having an upper end that abuts against said second electrically conductive terminal and a lower end that is urged by said finger portion as said rolling member slides along said sliding path between said right and left positions against a biasing action of said biasing spring.

2. The contact indicating switch as claimed in claim 1, further comprising a resilient conductive member mounted on said left terminal portion to provide a resilient contact pad for engaging said first electrically conductive wire.

3. The contact indicating switch as claimed in claim 2, wherein said resilient conductive member is a coil spring.

4. The contact indicating switch as claimed in claim 1, wherein said actuator body further includes a button cap having a top wall with right and left side portions opposite to each other relative to said third axis, and a surrounding wall extending downwardly from a periphery of said top wall to terminate with a lower annular portion, said surrounding wall being disposed to fit with said upper body portion and including two mounting pins spaced apart from each other along said fourth axis for pivotally mounting said actuator body on said circumferential wall, said rolling member engaging slidably said electrically conductive lever at said right position in response to depression of said left side portion of said button cap, and at said left position in response to depression of said right side portion of said button cap.

5. The contact indicating switch as claimed in claim 4, wherein said insulating seat body further includes two partition walls extending upwardly from said bottom wall in said first longitudinal direction to engage said circumferential wall, and spaced apart from each other in a direction parallel to said fourth axis so as to divide said insulating seat body into a middle receiving space for receiving said right, left and middle terminal portions, and two side chambers which are respectively disposed below two clearances that are formed between said circumferential wall and said surrounding wall and which are respectively adjacent to said mounting pins so as to accumulate therein water permeating through said clearances, thereby preventing said middle receiving space from being intruded by the permeating water.

6. The contact indicating switch as claimed in claim 5, wherein said insulating seat body further has drainage outlets formed through said side chambers.

7. The contact indicating switch as claimed in claim 6, wherein said insulating seat body further includes two protrusions disposed in said middle receiving space, each of said protrusions projecting from said circumferential wall in said fourth axis so as to restrict further movement of said lower annular portion when one of said right and left side portions is depressed.

8. The contact indicating switch as claimed in claim 1, wherein said electrically activated indicator is a neon lamp.

9. The contact indicating switch as claimed in claim 1, wherein said current limiting element is a resistor.

* * * * *